US009745886B2

(12) United States Patent
Vaughn et al.

(10) Patent No.: US 9,745,886 B2
(45) Date of Patent: Aug. 29, 2017

(54) METHOD AND SYSTEMS FOR ADJUSTING FLOW RESISTANCE IN AN ENGINE COOLING SYSTEM

(71) Applicant: General Electric Company, Schenectady, NY (US)

(72) Inventors: Jared Davis Vaughn, Fairview, PA (US); Gregory Alan Marsh, Erie, PA (US)

(73) Assignee: General Electric Company, Schenectady, NY (US)

( * ) Notice: Subject to any disclaimer, the term of this patent is extended or adjusted under 35 U.S.C. 154(b) by 429 days.

(21) Appl. No.: 14/454,453

(22) Filed: Aug. 7, 2014

(65) Prior Publication Data

US 2016/0040583 A1 Feb. 11, 2016

(51) Int. Cl.

| | |
|---|---|
| ***F01P 7/14*** | (2006.01) |
| ***F01P 3/20*** | (2006.01) |
| *F02M 26/22* | (2016.01) |

(52) U.S. Cl.

CPC *F01P 3/20* (2013.01); *F01P 7/14* (2013.01); *F01P 2007/146* (2013.01); *F01P 2060/02* (2013.01); *F01P 2060/04* (2013.01); *F02M 26/22* (2016.02)

(58) Field of Classification Search

CPC ..... F01P 7/14; F01P 5/12; F01P 3/20; F01P 5/10; F01P 2007/146; F01P 2007/143

See application file for complete search history.

(56) References Cited

U.S. PATENT DOCUMENTS

| | | | | |
|---|---|---|---|---|
| 4,669,988 | A | 6/1987 | Breckenfeld et al. | |
| 4,744,336 | A | 5/1988 | Miller | |
| 6,233,149 | B1 | 5/2001 | Bailey et al. | |
| 2009/0314266 | A1 * | 12/2009 | Hori | F01P 7/165 123/568.12 |
| 2013/0050944 | A1 | 2/2013 | Shepard | |
| 2014/0123917 | A1 * | 5/2014 | Chellan | F01P 7/10 123/41.04 |

FOREIGN PATENT DOCUMENTS

EP 0766308 A2 2/1997

* cited by examiner

*Primary Examiner* — Jacob Amick

(74) *Attorney, Agent, or Firm* — Global Patent Operation; John A. Kramer

(57) ABSTRACT

Various methods and systems are provided for adjusting flow resistances in an engine cooling system. In one example, a method for an engine includes adjusting a first resistance of a radiator main return line to be greater than a second resistance of a sub-cooled return line in response to an engine speed below a threshold speed, the sub-cooled return line arranged in parallel with the radiator main return line in an engine cooling system.

20 Claims, 6 Drawing Sheets

METHOD AND SYSTEMS FOR ADJUSTING FLOW RESISTANCE IN AN ENGINE COOLING SYSTEM

BACKGROUND

Technical Field

Embodiments of the subject matter disclosed herein relate to an engine cooling system.

Discussion of Art

To reduce overheating of an engine and related components, a cooling system may route coolant through a single cooling circuit that includes the engine, a coolant pump, a radiator, and additional heat exchangers. The cooling system may have two parallel return paths from the radiator and back to the pump: a radiator main return path and sub-cooled return path. The sub-cooled return path may include more heat exchangers than the radiator main return path, thereby increasing a resistance of the sub-cooled return path relative to a resistance of the radiator main return path. Additionally, one or more of the heat exchangers may be positioned a vertical distance above the coolant pump. The coolant pump may be driven by an engine crankshaft and as engine speed decreases, flow and pressure in the engine cooling system may decrease. As a result, less coolant flow may flow through the sub-cooled return line and the components of the sub-cooled return line may not be completely flooded with coolant. This may cause thermal gradients to form across the un-flooded heat exchangers, thereby resulting in component degradation and non-homogeneous temperatures in the cooling system.

BRIEF DESCRIPTION

In one embodiment, a method for an engine comprises adjusting a first resistance of a radiator main return line to be greater than a second resistance of a sub-cooled return line in response to an engine speed below a threshold speed, the sub-cooled return line arranged in parallel with the radiator main return line in an engine cooling system.

DETAILED DESCRIPTION

The following description relates to embodiments of an engine cooling system. The engine cooling system includes a pump flowing fluid to a radiator and then to two parallel return paths coupled between the radiator and the pump. As engine speed decreases, the pump output may also decrease, thereby decreasing coolant flow to the higher resistance path of the two parallel return paths. In one example, the higher resistance path may be a sub-cooled return path including one or more heat exchangers and the other return path is a radiator main return line including fewer heat exchangers than the sub-cooled return path. As one example, a method for the engine includes adjusting a first resistance of the radiator main return line to be greater than a second resistance of the sub-cooled return line in response to an engine speed below a threshold speed, the sub-cooled return line arranged in parallel with the radiator main return line in the engine cooling system.

Figure 1:
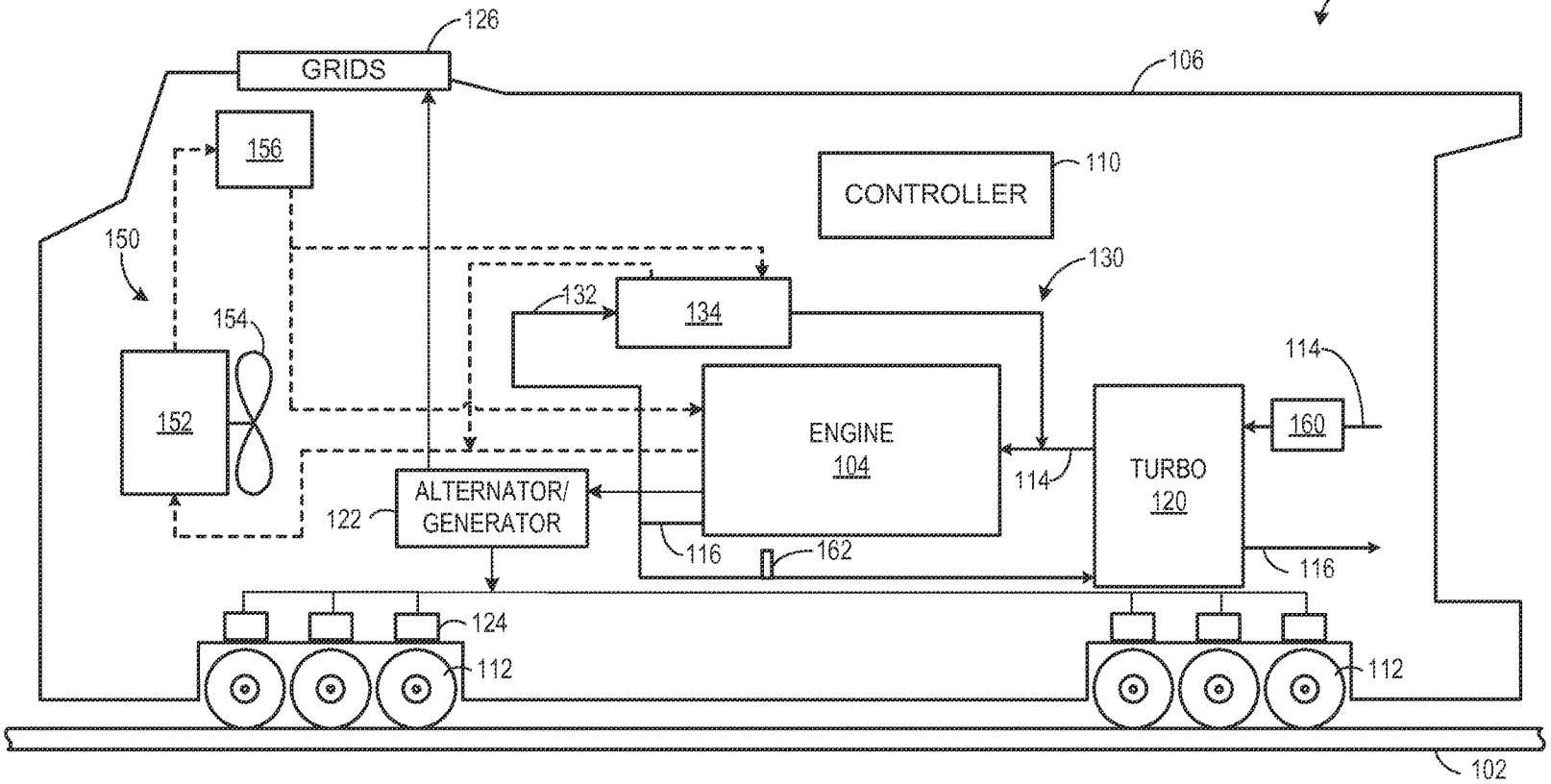
FIG. 1 shows a schematic diagram of a rail vehicle with an engine according to an embodiment of the invention.
Figure 4:
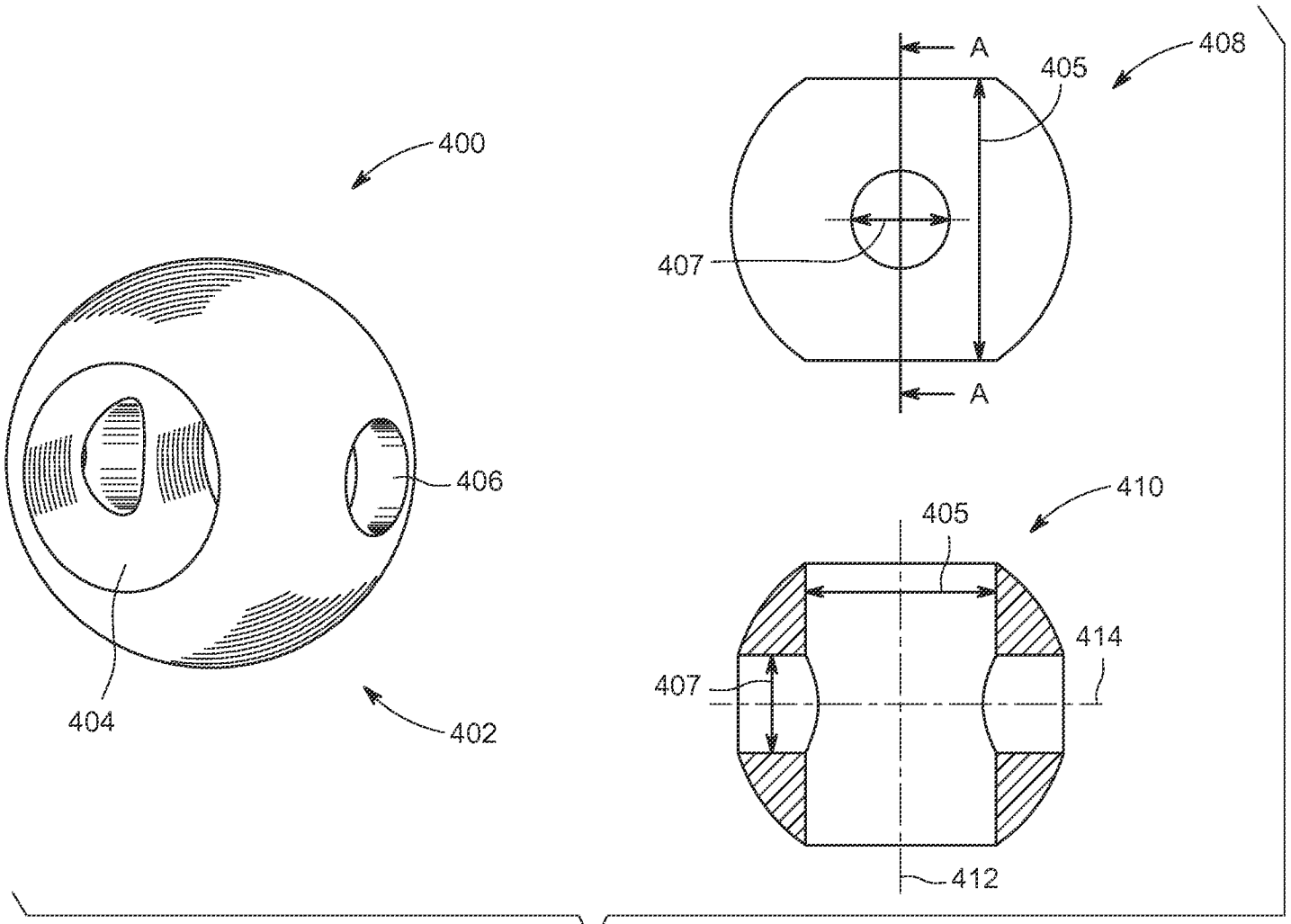
FIG. 4 shows a dual-orifice ball valve for an engine cooling system according to an embodiment of the invention.
Figure 5:
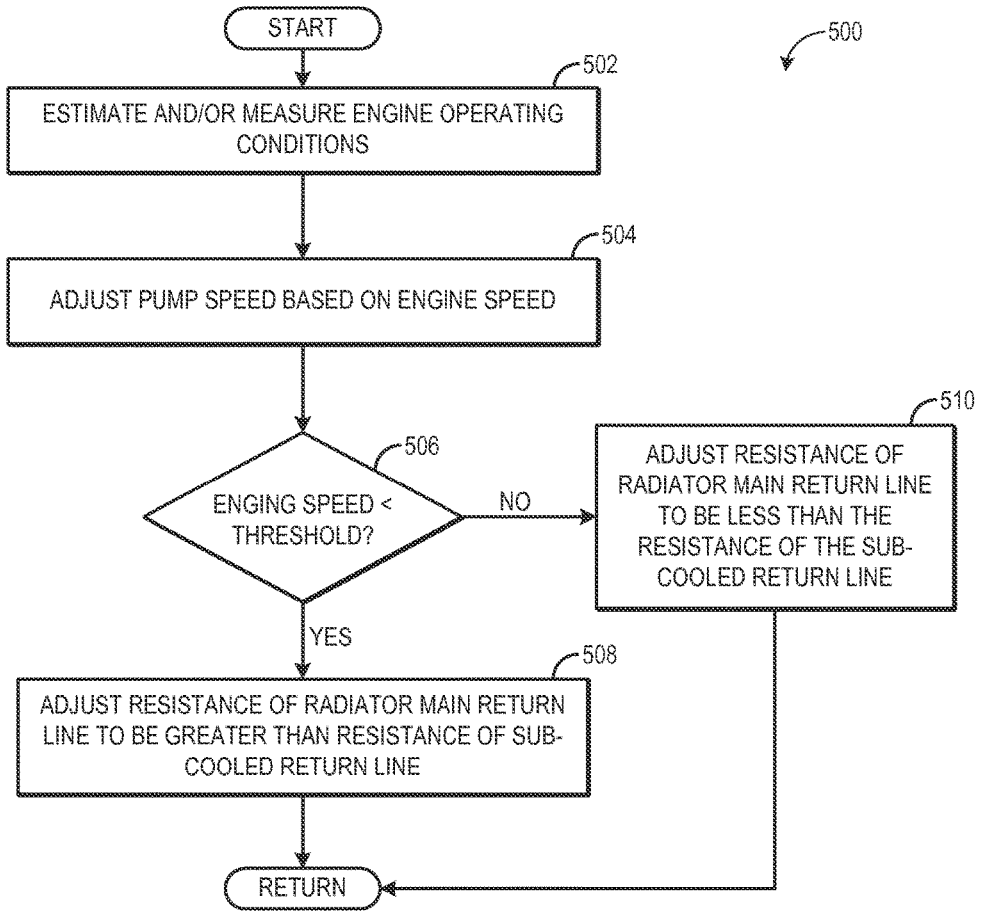
FIG. 5 shows a method for adjusting a restrictive element positioned in an engine cooling system according to an embodiment of the invention.
Figure 6:
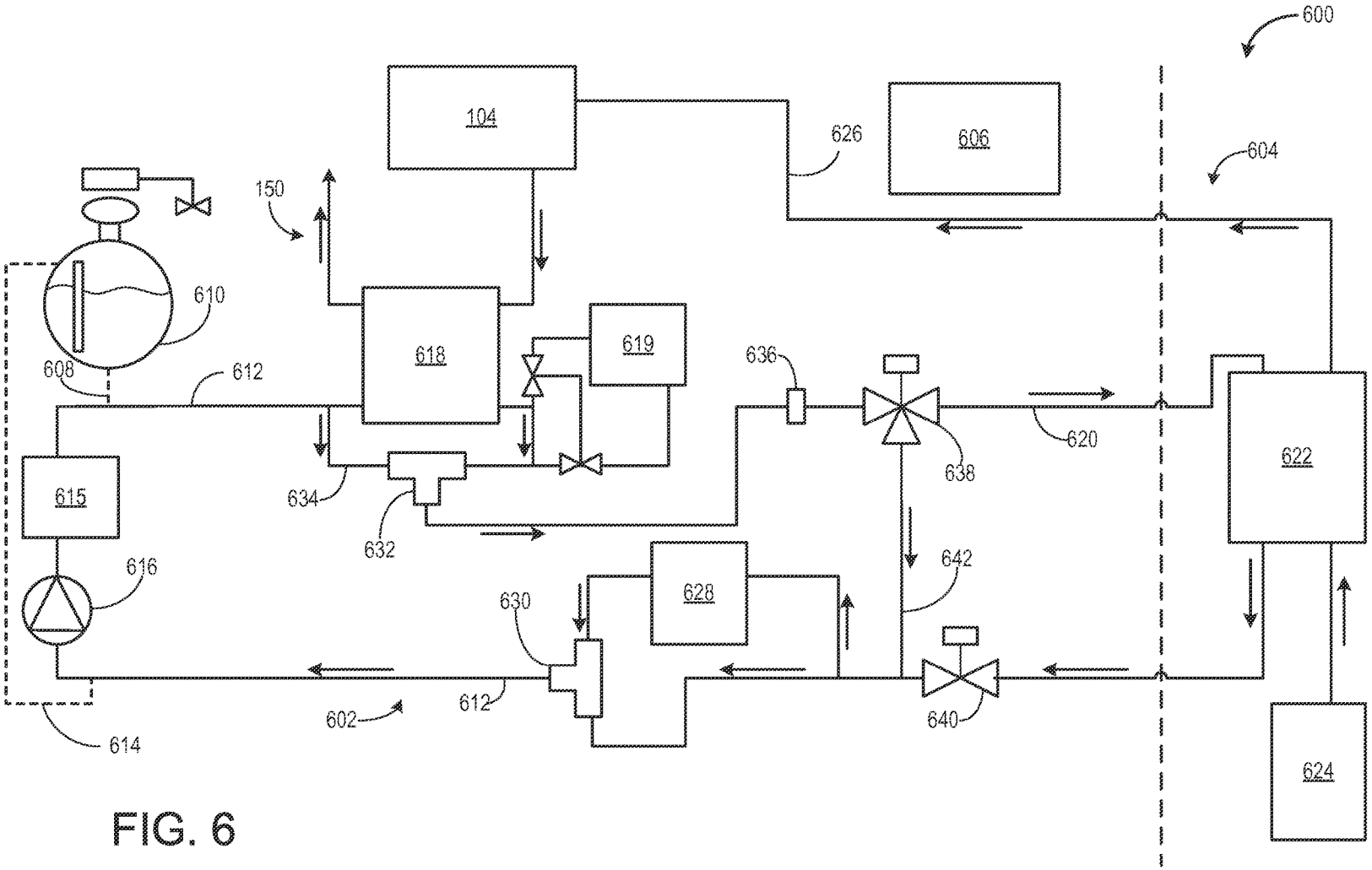
FIG. 6 shows of schematic of a system for transferring heat from engine coolant in an engine cooling system to a vaporizing fluid according to an embodiment of the invention.

One embodiment of a vehicle in which the engine may be installed is shown in FIG. 1. The engine is cooled with an engine cooling system, such as the engine cooling system of FIGS. 2-3. Additionally, the resistance of the two parallel return paths of the engine cooling system may be adjusted with a restrictive element positioned in one or more of the parallel return paths. In one example, the restrictive element is a valve, such as the dual-orifice ball valve shown in FIG. 4. Further, an engine controller may adjust a position of the restrictive element to increase or decrease the resistance of one of the parallel return paths relative to the other of the parallel return paths based on engine speed. FIG. 5 shows a method for adjusting the restrictive element in order to maintain flooding of all the engine cooling system components at different engine speeds. Further, FIG. 6 shows an embodiment of an additional heat exchanger arranged in the engine cooling system and providing heating to a secondary vaporizing fluid, the vaporizing fluid used for vaporizing LNG at a vaporizer.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

Before further discussion of the approach for adjusting the resistance of a radiator main return line relative to the resistance of a sub-cooled return line in an engine cooling system, an example of a platform is disclosed in which an engine and engine cooling system may be configured for a vehicle, such as a rail vehicle. For example, FIG. 1 shows a block diagram of an embodiment of a vehicle system 100, herein depicted as a rail vehicle 106 (e.g., locomotive), configured to run on a rail 102 via a plurality of wheels 112. As depicted, the rail vehicle includes an engine 104. In other non-limiting embodiments, the engine may be a stationary engine, such as in a power-plant application, or an engine in a marine vessel or other off-highway vehicle propulsion system as noted above.

The engine receives intake air for combustion from an intake passage 114. The intake passage receives ambient air from an air filter 160 that filters air from outside of the rail vehicle. Exhaust gas resulting from combustion in the engine is supplied to an exhaust passage 116. Exhaust gas flows through the exhaust passage, and out of an exhaust stack of the rail vehicle. In one example, the engine is a diesel engine that combusts air and diesel fuel through compression ignition. In another example, the engine is a dual or multi-fuel engine that may combust a mixture of gaseous fuel and air upon injection of diesel fuel during compression of the air-gaseous fuel mix. In other non-limiting embodiments, the engine may additionally combust fuel including gasoline, kerosene, natural gas, biodiesel, or other petroleum distillates of similar density through compression ignition (and/or spark ignition).

In one embodiment, the rail vehicle is a diesel-electric vehicle. As depicted in FIG. 1, the engine is coupled to an electric power generation system, which includes an alternator/generator 122 and electric traction motors 124. For example, the engine is a diesel and/or natural gas engine that generates a torque output that is transmitted to the alternator/generator which is mechanically coupled to the engine. In one embodiment herein, the engine is a multi-fuel engine operating with diesel fuel and natural gas, but in other examples the engine may use various combinations of fuels other than diesel and natural gas.

The alternator/generator produces electrical power that may be stored and applied for subsequent propagation to a variety of downstream electrical components. As an example, the alternator/generator may be electrically coupled to a plurality of traction motors and the alternator/generator may provide electrical power to the plurality of traction motors. As depicted, the plurality of traction motors are each connected to one of the plurality of wheels to provide tractive power to propel the rail vehicle. One example configuration includes one traction motor per wheel set. As depicted herein, six traction motors correspond to each of six pairs of motive wheels of the rail vehicle. In another example, alternator/generator may be coupled to one or more resistive grids 126. The resistive grids may be configured to dissipate excess engine torque via heat produced by the grids from electricity generated by alternator/generator.

In some embodiments, the vehicle system may include a turbocharger 120 that is arranged between the intake passage and the exhaust passage. The turbocharger increases air charge of ambient air drawn into the intake passage in order to provide greater charge density during combustion to increase power output and/or engine-operating efficiency. The turbocharger may include a compressor (not shown) which is at least partially driven by a turbine (not shown). While in this case a single turbocharger is included, the system may include multiple turbine and/or compressor stages. Additionally or alternatively, in some embodiments, a supercharger may be present to compress the intake air via a compressor driven by a motor or the engine, for example. Further, in some embodiments, a charge air cooler (e.g., water-based intercooler) may be present between the compressor of the turbocharger or supercharger and intake manifold of the engine. The charge air cooler may cool the compressed air to further increase the density of the charge air.

In some embodiments, the vehicle system may further include an aftertreatment system coupled in the exhaust passage upstream and/or downstream of the turbocharger. In one embodiment, the aftertreatment system may include a diesel oxidation catalyst (DOC) and a diesel particulate filter (DPF). In other embodiments, the aftertreatment system may additionally or alternatively include one or more emission control devices. Such emission control devices may include a selective catalytic reduction (SCR) catalyst, three-way catalyst, $NO_x$ trap, or various other devices or systems.

The vehicle system may further include an exhaust gas recirculation (EGR) system 130 coupled to the engine, which routes exhaust gas from the exhaust passage of the engine to the intake passage downstream of the turbocharger. In some embodiments, the exhaust gas recirculation system may be coupled exclusively to a group of one or more donor cylinders of the engine (also referred to a donor cylinder system). As depicted in FIG. 1, the EGR system includes an EGR passage 132 and an EGR cooler 134 to reduce the temperature of the exhaust gas before it enters the intake passage. By introducing exhaust gas to the engine, the amount of available oxygen for combustion is decreased, thereby reducing the combustion flame temperatures and reducing the formation of nitrogen oxides (e.g., $NO_x$).

In some embodiments, the EGR system may further include an EGR valve for controlling an amount of exhaust gas that is recirculated from the exhaust passage of the engine to the intake passage of the engine. The EGR valve may be an on/off valve controlled by a controller 110, or it may control a variable amount of EGR, for example. As shown in the non-limiting example embodiment of FIG. 1, the EGR system is a high-pressure EGR system. In other embodiments, the vehicle system may additionally or alternatively include a low-pressure EGR system, routing EGR from downstream of the turbine to upstream of the compressor.

As depicted in FIG. 1, the vehicle system further includes a cooling system 150 (e.g., engine cooling system). The cooling system circulates coolant through the engine to absorb waste engine heat and distribute the heated coolant to a heat exchanger, such as a radiator 152 (e.g., radiator heat exchanger). In one example, the coolant may be water. A fan 154 may be coupled to the radiator in order to maintain an airflow through the radiator when the vehicle is moving slowly or stopped while the engine is running. In some examples, fan speed may be controlled by the controller. Coolant which is cooled by the radiator may enter a tank (not shown). The coolant may then be pumped by a water, or coolant, pump 156 back to the engine or to another component of the vehicle system, such as the EGR cooler and/or charge air cooler.

The rail vehicle further includes the controller (e.g., engine controller) to control various components related to the rail vehicle. As an example, various components of the vehicle system may be coupled to the controller via a communication channel or data bus. In one example, the controller includes a computer control system. The controller may additionally or alternatively include a memory holding non-transitory computer readable storage media (not shown) including code for enabling on-board monitoring and control of rail vehicle operation. In some examples, the controller may include more than one controller each in communication with one another, such as a first controller to control the engine and a second controller to control other operating parameters of the locomotive (such as tractive motor load, blower speed, etc.). The first controller may be configured to control various actuators based on output received from the second controller and/or the second controller may be configured to control various actuators based on output received from the first controller.

The controller may receive information from a plurality of sensors and may send control signals to a plurality of actuators. The controller, while overseeing control and management of the engine and/or rail vehicle, may be configured to receive signals from a variety of engine sensors, as further elaborated herein, in order to determine operating parameters and operating conditions, and correspondingly adjust various engine actuators to control operation of the engine and/or rail vehicle. For example, the engine controller may receive signals from various engine sensors including, but not limited to, engine speed, engine load, intake manifold air pressure, boost pressure, exhaust pressure, ambient pressure, ambient temperature, exhaust temperature, particulate filter temperature, particulate filter back pressure, engine coolant pressure, gas temperature in the EGR cooler, or the like. The controller may also receive a signal of an amount of water in the exhaust from an exhaust oxygen sensor 162. Additional sensors, such as coolant temperature sensors, may be positioned in the cooling system and will be described further below with reference to FIG. 2. Correspondingly, the controller may control the engine and/or the rail vehicle by sending commands to various components such as the traction motors, the alternator/generator, fuel injectors, valves, or the like. For example, the controller may control the operation of a restrictive element (e.g., such as a valve) in the engine cooling system, as described further below. Other actuators may be coupled to various locations in the rail vehicle.

Figure 2:
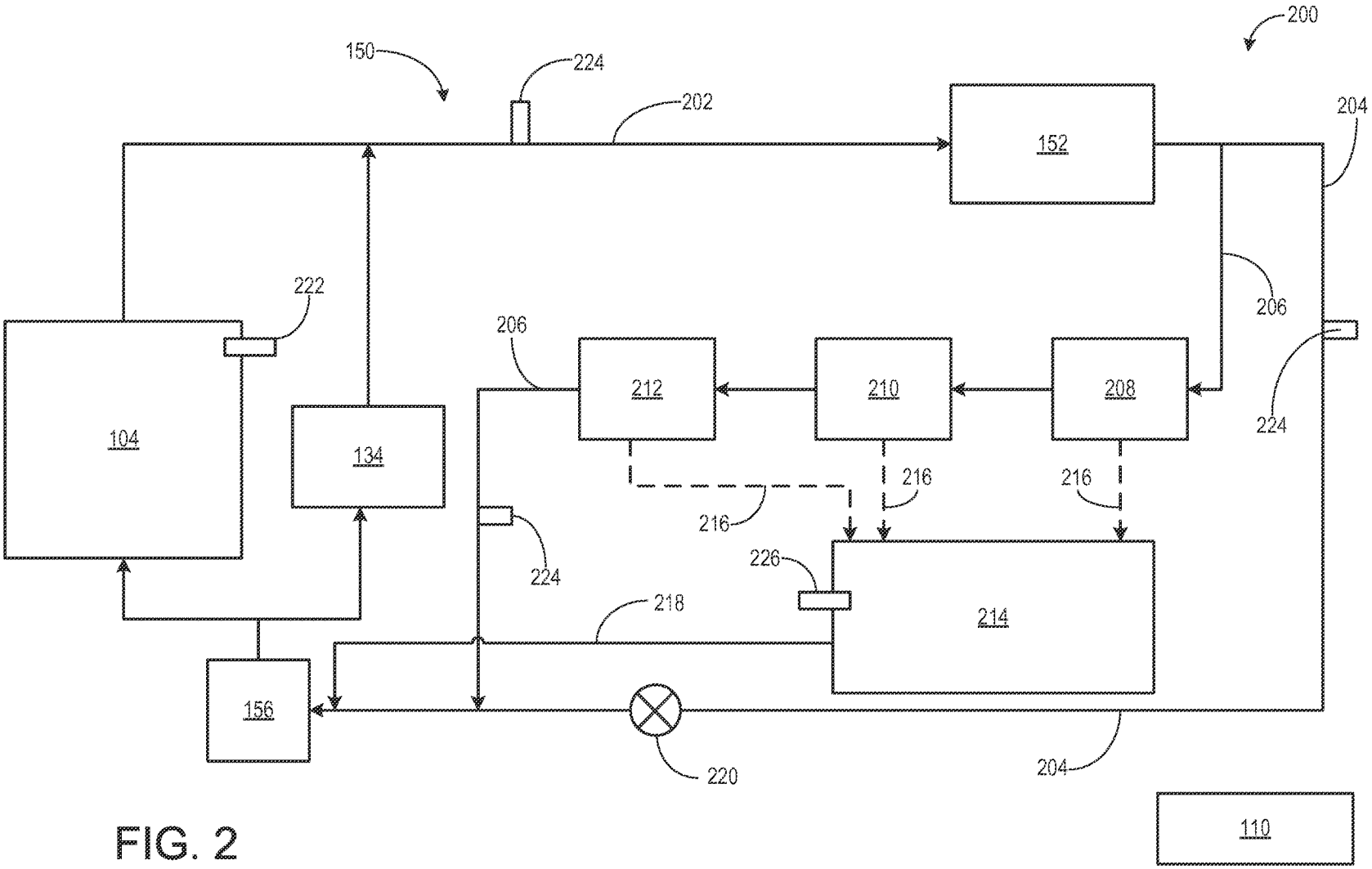
FIG. 2 shows a schematic of an engine cooling system according to an embodiment of the invention.

FIG. 2 shows a schematic 200 of an engine cooling system (such as the cooling system 150 shown in FIG. 1). The engine cooling system 150 (e.g., engine cooling circuit) shown in FIG. 2 may have similar components to those described above with reference to FIG. 1. As such, the similar components are likely numbered in FIG. 2. The engine cooling system includes a pump 156 (e.g., coolant or water pump). In one example, the pump is a crankshaft driven pump (e.g., driven by an engine crankshaft) that rotates proportionally with engine speed. Additionally, as shown in FIG. 2, the pump is a single pump providing flow to all the components in the engine cooling system. More specifically, as one example, the pump is the only pump anywhere in the engine cooling system.

The pump provides coolant flow to all the engine cooling system components. In one example, the coolant pumped through the engine cooling system is water. In another example, the coolant in the engine cooling system is another type of coolant. Cooled engine coolant flows from the pump to the engine 104 and the EGR cooler 134 to provide cooling to engine components and exhaust flowing through the EGR cooler. The engine and EGR cooler are positioned in parallel with one another in the cooling circuit, downstream from the pump. Warmer engine coolant exits the engine and the EGR cooler and then rejoins into a heated engine coolant line 202. Warmer engine coolant is pumped through the heated engine coolant line to the radiator 152. The radiator is a radiator heat exchanger which removes heat from the coolant and may be referred to herein as the main radiator of the engine cooling system. After the radiator, the engine cooling circuit branches into two parallel return flow paths: a radiator main return line 204 and a sub-cooled return line 206. Both the radiator main return line and the sub-cooled return line flow cooled coolant back to the pump. As such, the pump must provide propulsive power to flow coolant through the components in both the return lines.

The sub-cooled return line is coupled between the radiator and the pump. Further, the sub-cooled return line includes a plurality of heat exchangers. As shown in FIG. 2, the sub-cooled return line includes a sub-cooler heat exchanger 208, an oil heat exchanger 210, and a water-based intercooler 212. Thus, coolant flows through the sub-cooled return line from the radiator, to the sub-cooler heat exchanger, the oil heat exchanger, and the water-based intercooler. The sub-cooler heat exchanger may provide additional cooling to the engine coolant, thereby providing sub-cooling to the engine coolant, the oil heat exchanger provides cooling to engine oil, and the water-based intercooler provides cooling to intake air after passing through a compressor of a turbocharger.

The engine cooling system includes one or more coolant (e.g., water) tanks 214. In one example, the engine cooling system includes two water tanks positioned in series with one another. Coolant flowing out of vents of the heat exchangers in the sub-cooled return line (e.g., sub-cooler heat exchanger, oil heat exchanger, and/or water-based intercooler) may flow into a first water tank via vent lines 216. If the system includes two water tanks in series, the first water tank may be a top water tank stacked above a second water tank. Water then flows into the second water tank and then back into the pump inlet via a coolant supply line 218.

The radiator main return line includes fewer components (e.g., heat exchangers) than the sub-cooled return line. As one example, as shown in FIG. 2, the radiator main return line includes no additional heat exchangers. As a result of the radiator main return line having fewer heat exchangers than the sub-cooled return line, the resistance of the radiator main return line may be lower than the resistance of the sub-cooled return line. Additionally, in some embodiments, a diameter of the radiator main return line is larger than the diameter of the sub-cooled return line. For example, the radiator main return may have a diameter of approximately 4 inches while the sub-cooled return line may have a diameter of approximately 2 inches. Thus, the radiator main return line has fewer restrictive elements (e.g., no heat exchangers) and a larger flow path diameter, thereby causing coolant to preferentially flow through the radiator main return line over the sub-cooled return line.

Figure 3:
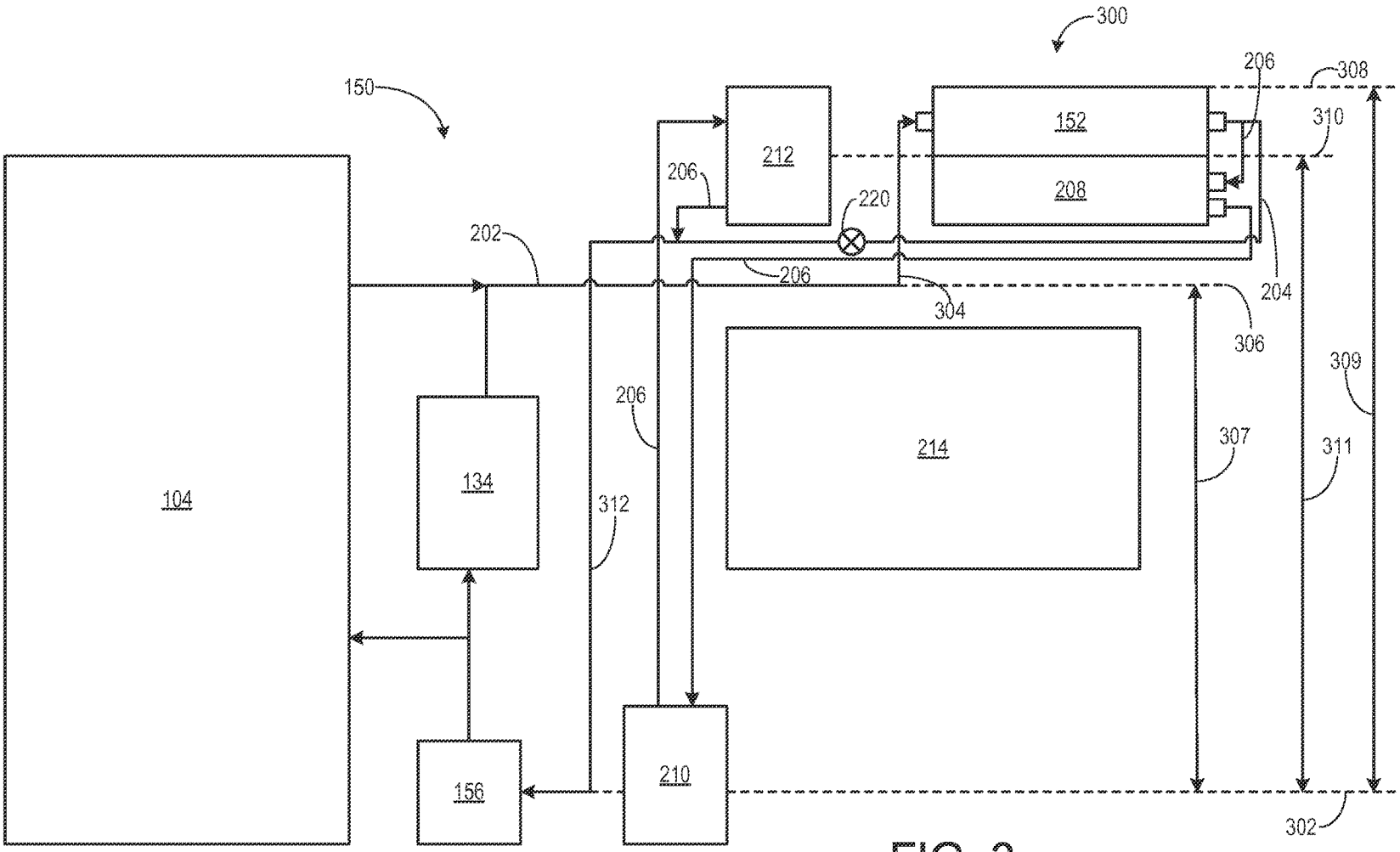
FIG. 3 shows a schematic of a vertical position of components of an engine cooling system relative to a coolant pump according to an embodiment of the invention.

When the coolant flows through the path of least resistance (radiator main return line), if the system pressure at the sub-cooled return line is not high enough, the components of the sub-cooled return line may not be flooded with coolant. As referred to herein, flooded components refer to components (such as heat exchangers) which are completely filled with coolant. For example, the cooling tubes of flooded heat exchangers may be completely filled with coolant such that there is no air in the coolant tubes. If the heat exchange components are not flooded with coolant, thermal gradients may form across the heat exchangers and/or coolers. As a result, thermal stress may cause degradation of the cooling system components. Additionally, the temperature in the heat exchangers may not be homogeneous, thereby decreasing the cooling efficiency of each component and the engine cooling system. If the sub-cooled return line loses coolant flow (e.g., coolant flow below a threshold flow is provided to the sub-cooled return line), a difference in temperature between the oil and coolant may result. This difference in temperature may falsely indicate engine component failure and result in the controller 110 shutting down the engine. Pressures in the cooling system may be based on pump speed at different engine operating conditions and the vertical heights of each component with respect to the pump height. This is described further below with reference to FIG. 3 showing the height of engine cooling system components relative to the pump. Pump speed and outlet pressure may increase with increasing engine speed (or notch level). In one example, when engine speed is below a threshold (e.g., at engine idle conditions), the pump speed and outlet pressure may not be sufficient to provide flow and flooding to the components of the sub-cooled return line.

One or more restrictive (e.g., resistive) elements may be positioned in the radiator main return line and/or the sub-cooled return line to adjust flow through the two parallel return lines in order to maintain flooding of all components at different engine operating conditions. As shown in FIG. 2, a restrictive element 220 (e.g., resistive element) is positioned in the radiator main return line. In one example, the restrictive element is a valve adapted to adjust a diameter of the flow path through the valve. As shown in FIG. 4, described further below, the valve may be a valve with two different diameter orifices. In another example, the restrictive element may be another type of valve or adjustable element that may block a portion of the flow path through the radiator main return line. For example, the restrictive element may be a flapper valve, a sliding valve, or another type of adjustable valve that may block varying amounts of the flow path in which it is coupled within.

The controller may adjust a position of the restrictive element based on engine operating conditions including engine speed. In some embodiments, the restrictive element may be adjusted only based on engine speed and not based on system temperatures (e.g., engine temperature and/or coolant temperature). For example, when engine speed is at or above a threshold speed, the controller may adjust the restrictive into a first position. In the first position, the resistance of the radiator main return line may be smaller than the resistance of the sub-cooled return line. In another example, the first position may be a position that provides minimal to no flow restriction in the radiator main return line. As such, the first position may allow for unrestricted flow through the radiator main return line. Alternatively, when engine speed is below the threshold speed, the controller may adjust the restrictive element into a second position. The second position may restrict the flow through the radiator main return line by a greater amount than when in the first position. In one example, in the second position, the resistance (e.g., flow resistance) of the radiator main return line may be greater than the resistance of the sub-cooled return line. As a result, more coolant may flow through the sub-cooled return line than the radiator main return line, thereby providing complete flooding of the heat exchangers in the sub-cooled return line. However, in the second position, coolant still flows through the radiator main return line. Thus, no position of the restrictive element ever completely restricts (e.g., blocks) flow through either of the sub-cooled return line or the radiator main return line. In this way, the resistances of both parallel return lines are always non-zero and flow is always flowing through both the sub-cooled return line and the radiator main return line at all engine speeds (including engine idle speed). In another example, in the second position, the resistance of the radiator main return line may not be greater than the resistance of the sub-cooled return line. However, in this example, the resistance of the radiator main return line is increased from the first position by an amount that provides enough flow and pressure to the sub-cooled return line in order to fully flood the heat exchangers of the sub-cooled return line.

In an alternate embodiment, the restrictive element may be positioned in the sub-cooled return line instead of the radiator main return line. In this example, the controller may adjust the restrictive element to restrict flow through the sub-cooled return line when engine speed is greater than the threshold speed and not restrict flow through the sub-cooled return line when engine speed is less than the threshold speed. The diameters of the two parallel return lines, the restrictive element, and/or the pump settings may be adapted such that when engine speed is below the threshold speed, the resistance through the sub-cooled return line is decreased below the resistance of the radiator main return line.

As discussed further below with reference to FIG. 4, the restrictive element may be adapted to provide sufficient flow through the sub-cooled return line at every engine speed (e.g., even engine idle speed) such that all components in the sub-cooled return line are completely flooded, thereby providing a homogeneous temperature across each component.

The engine cooling system includes a variety of sensors sending signals to the controller. The controller may then use these signals to adjust operation of the pump and/or adjust a position of the restrictive element. For example, the engine cooling system may include an engine temperature sensor 222 and one or more engine coolant temperature sensors positioned throughout the engine cooling circuit. As shown in FIG. 2, engine coolant sensors 224 are positioned in the heated engine coolant line, downstream from the engine, in the radiator main return line, and the sub-cooled return line, downstream from the water-based intercooler. In alternate embodiments, the engine cooling system may only include one or two of these engine coolant sensors. In another embodiment, the engine cooling system may include additional or alternative engine coolant sensors positioned in alternate locations (e.g., downstream from the pump and upstream from the engine). The one or more water tanks may include a water level sensor 226 indicating a level of coolant in the one or more water tanks.

Turning now to FIG. 3, a schematic 300 shows a vertical position of each of the engine cooling system components relative to the single coolant pump. The vertical height of each component may be relative to a vertical direction, the vertical direction relative to a surface on which a vehicle in which the engine is installed sits. As such, components with a larger vertical height may be positioned vertically above components with a smaller vertical height.

The pump 156 is positioned at a first position 302. The first position may be a base position from which the vertical heights of all other components or flow conduits (e.g., flow lines) are measured. More specifically, the first position is positioned at a pump inlet of the pump. The pump pumps fluid upward to the engine 104 and the EGR cooler 134 which are in parallel with one another in the engine cooling circuit (e.g., engine cooling system 150). From the engine and EGR cooler, the pump pumps coolant through the heated engine coolant line 202 to an inlet 304 (e.g., inlet line) to the radiator 152 and the sub-cooler heater exchanger 208. The inlet to the radiator 152 is at a second position 306. The second position is at a first vertical height 307 above the pump (e.g., above a height of the pump inlet). In one example, the first vertical height may be in a range of about 188 to about 208 cm (74-82 in). In another example, the first vertical height may be approximately 198 cm (78 in).

The pump then pumps coolant from the inlet to the radiator and through the radiator core. A top corner of the radiator (and the radiator core) is at a third position 308. The top corner of the radiator may be the topmost position that the pump must pump coolant to in the engine cooling system. The third position is at a second vertical height 309 above the pump. The second vertical height is greater than the first vertical height. In one example, the second vertical height may be in a range of about 254 cm to about 280 cm (100-110 in). In another example, the second vertical height may be approximately 264 cm (104 in).

From the radiator, coolant is then pumped to either the sub-cooler heat exchanger 208 in the sub-cooled return line 206 or the radiator main return line 204. As discussed above with regard to FIG. 2, the radiator main return line includes fewer components than the sub-cooled return line. As such, the pump may flow coolant downward through the radiator main return line from the radiator (at the third position) and back to the pump (at the first position). As shown in FIG. 3, the radiator main return line includes the restrictive element 220. The restrictive element may be positioned in the main return line anywhere upstream of where the sub-cooled return line re-joins with the radiator main return line upstream of the pump inlet.

In one example, as shown in FIG. 3, the sub-cooler heat exchanger is coupled to and below the radiator. Further, the sub-cooler may include one or more cooling cores. For example, the sub-cooler may include two stacked cores, each stacked below the radiator core. As such, coolant flows through the sub-cooler heat exchanger, downward from the radiator to the sub-cooler heat exchanger outlet. Coolant then flows from the sub-cooler heat exchanger and vertically downward through the sub-cooled return line to the oil heat exchanger 210. The oil heat exchanger is positioned approximately at the first position. As such, the oil heat exchanger is positioned at approximately the same vertical height as the pump.

From the oil heat exchanger, the coolant is pumped vertically upward to the water-based intercooler 212. The water-based intercooler is positioned at a fourth position 310. The fourth position is at a third vertical height 311 above the pump (e.g., above the pump inlet). The third vertical height is greater than the first vertical height of the radiator inlet and less that the second vertical height of the top of the radiator. In one example, the third vertical height is in a range of about 238 cm to about 259 cm (94-102 in). In another example, the third vertical height is approximately 249 cm (98 in).

Coolant then flows from the water-based intercooler and to the radiator main return line where the two parallel return lines join into one return line. A joined portion of the radiator main return line 312 then carries coolant from both the radiator main return line upstream of the joining point and the sub-cooled return line to the pump inlet. In an alternate embodiment, both the radiator main return line and the sub-cooled return line may join and enter the pump at the pump inlet.

As shown in FIG. 3, the radiator, the sub-cooler heat exchanger, and the water-based intercooler are all positioned at similar vertical positions. In one embodiment, the radiator, sub-cooler heat exchanger, and water-based intercooler may all be positioned on an upper radiator rack positioned vertically above the pump, the engine, and the water tanks 214. Further, as shown in FIG. 3, the water tanks 214 are positioned vertically below the sub-cooler heat exchanger and the water-based intercooler and vertically above the pump.

Thus, the pump must provide enough pressure to pump coolant to at least the third position 308 (e.g., the second vertical height above the pump). Additionally, this pressure must be sufficient to drive flow through the heat exchangers. In this way, the pump outlet pressure may be based on the second vertical height. For example, a pump outlet pressure of approximately 26.3 kPa (3.8 psig) may lift the coolant to approximately 274 cm (108 in) in elevation.

As heat exchange requirements of engines increase, higher flows through the coolant system may be necessary to provide the required heat rejection. For example, engines utilizing higher EGR flow rates may require larger EGR coolers capable of transferring more heat from recirculated exhaust gases and to the engine coolant system. In one example, increased coolant pump flows and larger cooling system piping may help to increase heat rejection in the cooling system heat exchangers, including the EGR cooler. In order to achieve the required higher pump flow rates at higher engine speeds, the system backpressure may be reduced. Thus, in one example, the cooling system backpressure may be selected to provide high pump flows at high engine loads. However, at lower engine loads and lower pump speeds (e.g., since the pump is crank-driven), the system backpressure may be even smaller. As a result of the lower backpressure, it may be more difficult for coolant to reach the cooling system components positioned at the highest vertical heights in the system (e.g., the radiator, sub-cooler heat exchanger, and the water-based intercooler). Thus, when engine speed is below the threshold speed, these higher positioned heat exchangers (relative to the pump height) may not be completely flooded with coolant. As discussed above, this may result in thermal gradients forming across the heat exchangers, thereby resulting in increased mechanical stress and component degradation. Additionally, since only a single pump (e.g., coolant pump) is providing coolant flow to all the components in both a radiator main return line and a sub-cooled return line, flow may preferentially flow through the lower-resistance radiator main return line, thereby further decreasing pressure at the heat exchangers of the sub-cooled return line. This further decreased pressure further reduces the flooding of the components of the sub-cooled return line.

Adjusting the restrictive element (e.g., valve) in the engine cooling system to maintain flow through the sub-cooled return line and maintain flooding of the components of the sub-cooled return line may decrease thermal gradients across these components and thus the mechanical stress on the components. FIG. 4 shows an embodiment of a restrictive element, such as restrictive element 220 shown in FIGS. 2-3. As shown in FIG. 4, the restrictive element is a ball valve. FIG. 4 shows a first isometric view 400 of a ball 402 included in the ball valve. FIG. 4 also shows a side view 408 of the ball and a section view 410 taken along the section A-A in the side view. The ball includes two orifices with circular cross-sections. A first orifice 404 has a first diameter 405 and a second orifice 406 has a second diameter 407, the first diameter greater than the second diameter. A first central axis 412 of the first orifice is perpendicular to a second central axis 414 of the second orifice. Further, the first central axis and the second central axis may be positioned within a center of the ball. Further the first orifice and the second orifice extend through an entire diameter of the ball. As a result, the ball has four openings on the outer surface of the ball defined by the orifices. As shown in the section view, two openings having the second diameter are positioned opposite one another on the outer surface of the ball with respect to the first central axis. Similarly, two different openings having the first diameter are positioned opposite one another on the outer surface of the ball with respect to the second central axis.

As one embodiment, the ball valve with the two differently sized orifices may be positioned in the radiator main return line, as shown by the restrictive element 220 in FIGS. 2-3. When engine speed is above the threshold speed, the controller may adjust the ball valve such that the first orifice is in-line with flow through the radiator main return line. Said another way, the first central axis of the first orifice may be parallel to a central flow axis of the radiator main return line such that coolant flows through the first orifice. Then, when engine speed is below the threshold speed, the controller may adjust the ball valve such that the second orifice is in-line with flow through the radiator main return line. Said another way, the second central axis of the second orifice may be parallel to the central flow axis of the radiator main return line such that coolant flow through the second orifice. Since the second orifice is smaller than the first orifice, resistance is the radiator main return line is increased when coolant flows through the second orifice relative to when coolant flow through the first orifice. In one example, the first diameter may be substantially the same as the diameter of the radiator main return line. Further, the second diameter is non-zero and the second orifice does not completely shut off flow in the main radiator return line.

In an alternate embodiment, the ball valve shown in FIG. 4 may instead be positioned in the sub-cooled return line. In this embodiment, when engine speed is above the threshold speed, the controller may adjust the valve such that the smaller, second orifice is in line with flow through the sub-cooled return line. Then, when engine speed is below the threshold speed, the controller may adjust the valve such that the larger, first orifice is in line with flow through the sub-cooled return line. In this way, resistance of the sub-cooled return line may be reduced when engine speed is below the threshold speed.

FIG. 5 shows a flow chart of a method 500 for adjusting a restrictive element positioned in the engine cooling system (e.g., such as the restrictive element 220 shown in FIGS. 2-3). In one embodiment, the restrictive element may be positioned in the radiator main return line. In another embodiment, the restrictive element may be positioned in the sub-cooled return line. A controller (such as controller 110 shown in FIGS. 1-2) may include instructions stored in a memory of the controller for carrying out method 500.

Method 500 begins at 502 by estimating and/or measuring engine operating conditions. Engine operating conditions may include engine speed, engine load, engine notch setting, engine coolant temperature, engine temperature, exhaust temperature, water in the exhaust, coolant level, or the like. At 504 the method includes adjusting the speed of the coolant pump in the engine cooling system (e.g., pump 156 shown in FIGS. 1-3) based on engine speed. As discussed above, the pump may be a crankshaft-driven pump such that the pump speed adjusts automatically with engine speed. Thus, as engine speed increases, the pump speed may increase. In another example, the pump speed may increase with increasing engine notch level. In alternate embodiments, the controller may adjust pump speed based on one or more of engine speed, coolant temperatures, and/or engine temperatures.

At 506, the method includes determining whether engine speed is less than a threshold speed. As introduced above, the threshold speed may be a speed below which a system backpressure output by the pump is not sufficient to flood all the heat exchange components of the sub-cooled return line (e.g., the sub-cooler heat exchanger and/or the water-based intercooler). In this way, the threshold engine speed may be based on a threshold pressure required to flood all cooling system components. In another embodiment, the threshold speed may be an engine idle speed. In yet another example, the threshold speed may be a threshold speed range. For example, the threshold engine speed range may be a range between engine idle and a second, higher threshold speed (e.g., such as notch 1). When operating at or below the threshold speed, the engine speed may be considered below the threshold speed.

If the engine speed is below the threshold speed (or in or below the threshold speed range) at 506, the controller adjusts the resistance of the radiator main return line to be greater than the resistance of the sub-cooled return line at 508. As a result, increased coolant flow may flow through the sub-cooled return line, thereby flooding the components of the sub-cooled return line. As one embodiment, adjusting the resistance of the radiator main return line to be greater than the resistance of the sub-cooled return line includes adjusting a position of a restrictive element (e.g., valve) positioned in the radiator main return line to increase the resistance of and restrict flow through the radiator main return line. For example, if the valve is the ball valve shown in FIG. 4, the method at 508 includes pneumatically actuating the valve to switch a position of the valve so that the smaller diameter orifice is positioned in-line with the flow path of the radiator main return line and coolant flows through the smaller diameter orifice. In an alternate embodiment, the valve (or any other restrictive element) may be hydraulically or electrically actuated. As another embodiment, adjusting the resistance of the radiator main return line to be greater than the resistance of the sub-cooled return line includes adjusting a position of a restrictive element (e.g., valve) positioned in the sub-cooled return line to decrease the resistance of and increase flow through the sub-cooled return line. For example, if the valve is the ball valve shown in FIG. 4, the method at 508 includes actuating the valve to switch a position of the valve so that the larger diameter orifice is positioned in-line with the flow path of the sub-cooled return line and coolant flow through the larger diameter orifice.

Alternatively at 506, if the engine speed is not less than the threshold speed, the method continues to 510 where the controller adjusts the resistance of the radiator main return line to be less than the resistance of the sub-cooled return line. As a result, increased coolant flow may flow through the radiator main return line. However, since the pump speed is increased with increased engine speed, cooling system backpressure is sufficient to flow coolant through both the return lines and fully flood the components of the sub-cooled return line. As one embodiment, adjusting the resistance of the radiator main return line to be less than the resistance of the sub-cooled return line includes adjusting a position of a restrictive element (e.g., valve) positioned in the radiator main return line to decrease the resistance of and increase flow through the radiator main return line. In one example, increasing flow through the radiator main return line may include allowing unrestricted flow through the radiator main return line. In another example, increasing flow through the radiator main return may include allowing less-restricted flow through the radiator main return line than when the engine speed was less than the threshold speed. For example, if the valve is the ball valve shown in FIG. 4, the method at 510 includes actuating the valve to switch a position of the valve so that the larger diameter orifice is positioned in-line with the flow path of the radiator main return line and coolant flows through the larger diameter orifice. As another embodiment, adjusting the resistance of the radiator main return line to be less than the resistance of the sub-cooled return line includes adjusting a position of a restrictive element (e.g., valve) positioned in the sub-cooled return line to increase the resistance of and decrease flow through the sub-cooled return line. For example, if the valve is the ball valve shown in FIG. 4, the method at 510 includes actuating the valve to switch a position of the valve so that the smaller diameter orifice is positioned in-line with the flow path of the sub-cooled return line and coolant flow through the smaller diameter orifice.

The adjusting at both 508 and 510 includes adjusting the resistances so that the resistances of the sub-cooled return line and the radiator main return line are both non-zero and flow is not blocked in either of the two parallel flow paths. For example, coolant is always flowing through the sub-cooled return line and the radiator main return line and no position of the restrictive element (e.g., valve) completely blocks flow through either of the radiator main return line or the sub-cooled return line at an engine speed (including engine idle speed). In this way, flow through the two parallel flow paths is adjusted to be more or less restricted, but flow is never fully restricted such that flow is zero through either parallel return flow path. Additionally, the adjusting of the restrictive element may be based on engine speed alone and not based on additional engine operating parameters such as engine and/or coolant temperature.

In another embodiment, the method at 508 may include adjusting the resistance of the radiator main return line to a first level. In this embodiment, the first level may not be greater than a resistance of the sub-cooled return line. However, the first level may be high enough to increase flow through the sub-cooled return line and completely flood all the heat exchangers in the sub-cooled return line. Similarly, in this embodiment, the method at 510 may include adjusting the resistance of the radiator main return line to a second level. The second level is less than the first level and less than the resistance of the sub-cooled return line. The resistance of the radiator main return line at different engine speeds may be based on a required inlet pressure the sub-cooled return line required to completely flood the heat exchange components.

In this way, adjusting the resistances of two parallel radiator return flow paths (e.g., the radiator main return line and the sub-cooled return line) based on engine speed may achieve the technical effect of flooding cooling system components (heat exchangers) at lower engine speeds (e.g., engine idle). Fully flooding the cooling system heat exchangers at all engine operating conditions decreases thermal gradients across the heat exchangers, thereby reducing mechanical stress and degradation of the heat exchangers. Further, maintaining coolant flow through the sub-cooled return line containing one or more cooling system heat exchangers may reduce temperature differentials between the oil and coolant, thereby decreasing unintended engine shut-downs.

Now turning to FIG. 6, a schematic 600 shows a system for transferring heat from engine coolant (e.g., engine cooling fluid) of the engine cooling system (such as engine cooling system 150 shown in FIGS. 1-3) to a vaporizing fluid. The vaporizing fluid may also receive heat from an AC inverter. The heated vaporizing fluid may then be used to deliver the waste heat from the AC inverter and engine coolant to a vaporizer that converts liquid fuel (e.g., liquid natural gas, LNG) to gaseous fuel (e.g., gaseous natural gas, CNG). An engine (e.g., such as engine 104 shown in FIGS. 1-3) may then combust CNG received from the vaporizer. In one example, the system shown in the schematic may be installed on a rail vehicle and fuel tender, such as the rail vehicle shown in FIG. 1. As such, at least some of the components described below with reference to FIG. 6 may also be included in the systems shown in FIGS. 1-3.

Schematic 600 shows an engine cooling system 150, a vaporizing fluid circuit 602, and a gaseous fuel system 604. The flow of vaporizing fluid through the vaporizing fluid circuit and the flow of liquid and gaseous fuel through the gaseous fuel system is at least partially controlled by a controller 606 (in one embodiment, may be the same as controller 110 shown in FIGS. 1-2). Vaporizing fluid is supplied to the vaporizing fluid circuit via a fluid supply line 608, the fluid supply line coupled between a vaporizing fluid storage tank 610 and a cooler flow passage 612. The vaporizing fluid storage tank includes a vent line 614 for venting vaporizing fluid vapors from the vaporizing fluid storage tank and to the cooler flow passage, upstream from a pump 616. The vaporizing fluid storage tank may include one or more alternate vent lines in addition to or in place of the vent line shown in FIG. 6.

The pump pumps the vaporizing fluid through an AC inverter 615, thereby transferring heat from the AC inverter and to the vaporizing fluid. From the AC inverter, the vaporizing fluid flows to a vaporizing fluid heat exchanger 618. The vaporizing fluid heat exchanger transfers heat from engine coolant flowing through the engine cooling circuit to vaporizing fluid in the vaporizing fluid circuit. In one embodiment, the vaporizing fluid heat exchanger may be positioned downstream of the engine 104 and upstream of the radiator (e.g., radiator 152 shown in FIGS. 1-3) in the engine cooling circuit. The vaporizing fluid may optionally flow through a cab heater 619 that removes heat from the vaporizing fluid circuit. Control of vaporizing fluid flow through the cab heater may be controlled by one or more valves. The vaporizing fluid then travels via a hotter fluid passage 620 to a vaporizer 622. At the vaporizer, heat from the vaporizing fluid is transferred to a liquid fuel passing through the vaporizer from a liquid fuel tank 624. As such, the heated vaporizing fluid is used by the vaporizer to vaporize the liquid fuel to gaseous fuel. Gaseous fuel then flows from the vaporizer and to the engine for consumption via gaseous fuel passage 626. After passing through the vaporizer, the vaporizing fluid flows back to the vaporizing fluid heat exchanger via the cooler flow passage to become heated again. As shown in FIG. 6, the vaporizing fluid may flow through a secondary radiator 628 that removes heat from the vaporizing fluid circuit. Flow of vaporizing fluid through the secondary radiator is controlled by a first thermostatic valve 630. In some embodiments, a liquid pump and/or air fan may be arranged proximate to the secondary radiator to enable heat exchange at the secondary radiator. The vaporizing fluid may be a freeze resistant fluid capable of efficient heat transfer. In one example, the vaporizing fluid may be a water-glycol mixture.

The flow of vaporizing fluid through the vaporizing fluid circuit and a temperature of the vaporizing fluid may be controlled by one or more valves, pumps, and a second thermostatic valve 632 positioned in a bypass passage 634 positioned around the vaporizing fluid heat exchanger. The second thermostatic valve is adapted to direct flow of the vaporizing fluid through the vaporizing fluid heat exchanger when a temperature of the vaporizing fluid is below a threshold temperature and to direct the flow of vaporizing fluid through the bypass passage (and not through the heat exchanger) when the temperature of the vaporizing fluid is above the threshold temperature. The temperature of the vaporizing fluid is measured by a temperature sensor 636 positioned downstream from the vaporizing fluid heat exchanger. In one embodiment, the second thermostatic valve may be passive and not controlled by the controller. However, in alternate embodiments, the bypass passage may include an active valve instead of the thermostatic valve, the active valve controlled by the controller.

Additionally, the controller may adjust the flow of vaporizing fluid through the vaporizing fluid circuit and to the vaporizer by adjusting one or more of the pump, a first active shut-off valve 638, and/or a second active shut-off valve 640. For example, the controller may close one or both of the first active shut-off valve and the second active shut-off valve in order to stop vaporizing fluid from flowing to the vaporizer. Alternately, the controller may open both the first active shut-off valve and the second shut-off valve in order to send vaporizing fluid to the vaporizer. Further still, the controller by adjust the first active-shut-off valve to bypass vaporizing fluid around the vaporizer via a second bypass passage 642.

In this way, in one embodiment, the vaporizing fluid heat exchanger may be an additional heat exchanger positioned within the engine cooling system of FIGS. 1-3.

As one embodiment, a method for an engine comprises adjusting a first resistance of a radiator main return line to be greater than a second resistance of a sub-cooled return line in response to an engine speed below a threshold speed, the sub-cooled return line arranged in parallel with the radiator main return line in an engine cooling system. It should be noted that "arranged in parallel" may mean fluidly parallel such that components in the sub-cooled return line and the radiator main return line are fluidly connected to the same inlet and outlet and not necessarily geometrically parallel. In one example, adjusting the first resistance to be greater than the second resistance includes adjusting a position of a first valve positioned in the radiator main return line to increase the first resistance and restrict flow through the radiator main return line. In another example, adjusting the first resistance to be greater than the second resistance includes adjusting a position of a second valve positioned in the sub-cooled return line to decrease the second resistance and increase flow through the sub-cooled return line. The first resistance and the second resistance are each non-zero. Additionally, the position of the first valve never fully blocks coolant flow in the radiator main return line and the position of the second valve never fully blocks coolant flow in the sub-cooled return line. The method further comprises adjusting the first resistance to be less than the second resistance in response to the engine speed above the threshold speed. In one example, the threshold speed is an engine idle speed. Further, engine coolant is supplied to each of the radiator main return line and the sub-cooled return line by only a single pump in the engine cooling system. The pump is a crankshaft driven pump that rotates proportionally with engine speed. Further still, flow is not blocked in the radiator main return line and the sub-cooled return line while the pump is operating.

An inlet to each of the radiator main return line and the sub-cooled return line is downstream from a radiator of the engine cooling system. The engine cooling system further includes an EGR cooler positioned upstream from the radiator and downstream from the pump. Additionally, the radiator is positioned at a first vertical height above the pump and the EGR cooler is positioned at a second vertical height above the pump, the first vertical height greater than the first vertical height. The sub-cooled return line includes more heat exchangers than the radiator main return line, the sub-cooled return line including one or more of a sub-cooler heat exchanger, an oil heat exchanger, or a water-based intercooler. The method further comprises flowing fluid vertically upward from the pump and to the radiator and flowing fluid vertically downward from the sub-cooler heat exchanger and to the oil heat exchanger.

As another embodiment, a method for an engine comprises during a first condition when engine speed is above a threshold speed, adjusting a resistance of a radiator main return line in parallel with a sub-cooled return line to a first level, the radiator main return line coupled between a radiator and a coolant pump. The method further comprises during a second condition when engine speed is below the threshold speed, adjusting the resistance of the radiator main return line to a second level, the second level higher than the first level. In one example, adjusting the resistance of the radiator main return line includes adjusting a position of a valve positioned in the radiator main return line. Further, adjusting the resistance of the radiator main return line to the first level includes increasing an opening of the valve to decrease the resistance in the radiator main return line and adjusting the resistance of the radiator main return line to the second level includes decreasing an opening of the valve to increase the resistance in the radiator main return line. Additionally, the second level is greater than a resistance of the sub-cooled return line. During both the first condition and the second condition, coolant flows through both the radiator main return line and the sub-cooled return line. Further still, the coolant pump is an only pump fluidly coupled to the radiator main return line and the sub-cooled return line and a speed of the coolant pump increases proportionally with increasing engine speed. In one example, the threshold speed is based on a fluid pressure required to fully flood components in the sub-cooled return line during the second condition.

As yet another embodiment, an engine cooling system comprises a single coolant pump driven by an engine crankshaft, an engine positioned downstream from the single coolant pump, a radiator positioned downstream from the engine, a radiator main return line coupled between the radiator and the single coolant pump, the radiator main return line including a restrictive element, a sub-cooled return line arranged in parallel with the radiator main return line, and a controller with computer readable instructions for adjusting a position of the restrictive element based on engine speed alone, the restrictive element maintaining non-zero flow through the radiator main return line at all positions. The system further comprises an EGR cooler positioned in parallel with the engine. The EGR cooler is positioned vertically above the single coolant pump with respect to a ground on which a vehicle in which the engine cooling system is installed sits and the radiator is positioned vertically above the EGR cooler. Further, the sub-cooled return line includes a sub-cooler heat exchanger, an oil heat exchanger, and a water-based intercooler. The radiator is positioned vertically above the sub-cooler heat exchanger and the sub-cooler heat exchanger is positioned vertically above the oil heat exchanger and the single coolant pump. Additionally, the restrictive element includes a dual-orifice valve movable between a first position restricting flow through the radiator main return line and a second position allowing unrestricted flow through the radiator main return line, where the first position aligns a smaller diameter orifice with a flow path of the radiator main return line and the second position aligns a larger diameter orifice with the flow path of the radiator main return line.

As used herein, an element or step recited in the singular and proceeded with the word "a" or "an" should be understood as not excluding plural of said elements or steps, unless such exclusion is explicitly stated. Furthermore, references to "one embodiment" of the invention do not exclude the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for an engine, comprising:

adjusting a first resistance of a radiator main return line to be greater than a second resistance of a sub-cooled return line in response to an engine speed below a threshold speed, the sub-cooled return line arranged in parallel with the radiator main return line in an engine cooling system.

2. The method of claim 1, wherein adjusting the first resistance to be greater than the second resistance includes adjusting a position of a first valve positioned in the radiator main return line, downstream of where the sub-cooled return line branches off from the radiator main return line, to increase the first resistance and restrict flow through the radiator main return line.

3. The method of claim 1, wherein adjusting the first resistance to be greater than the second resistance includes adjusting a position of a second valve positioned in the sub-cooled return line to decrease the second resistance and increase flow through the sub-cooled return line, wherein the first resistance and the second resistance are each non-zero, and wherein the position of the second valve never fully blocks coolant flow in the sub-cooled return line.

4. The method of claim 2, wherein the first resistance and the second resistance are each non-zero and wherein the position of the first valve never fully blocks coolant flow in the radiator main return line.

5. The method of claim 1, further comprising adjusting the first resistance to be less than the second resistance in response to the engine speed above the threshold speed.

6. The method of claim 1, wherein the threshold speed is an engine idle speed.

7. The method of claim 1, wherein engine coolant is supplied to each of the radiator main return line and the sub-cooled return line by only a single pump in the engine cooling system, wherein the radiator main return line and sub-cooled return line join upstream of the pump, wherein the pump is a crankshaft driven pump that rotates proportionally with engine speed, and wherein flow is not blocked in the radiator main return line and the sub-cooled return line while the pump is operating.

8. The method of claim 7, wherein an inlet to each of the radiator main return line and the sub-cooled return line is downstream from a radiator of the engine cooling system, wherein the engine cooling system further includes an EGR cooler positioned upstream from the radiator and downstream from the pump, wherein the pump provides engine coolant to each of the engine and EGR cooler in parallel, wherein coolant exiting the engine and the EGR cooler rejoins into a heated engine coolant line, upstream of the radiator, and wherein the radiator is positioned at a first vertical height above the pump and the EGR cooler is positioned at a second vertical height above the pump, the first vertical height greater than the second vertical height.

9. The method of claim 8, wherein the sub-cooled return line includes more heat exchangers than the radiator main return line, the sub-cooled return line including one or more of a sub-cooler heat exchanger, an oil heat exchanger, or a water-based intercooler and further comprising flowing fluid vertically upward from the pump and to the radiator and flowing fluid vertically downward from the sub-cooler heat exchanger and to the oil heat exchanger, and wherein the threshold speed is an engine speed below which a system backpressure output by the pump is not sufficient to flood the one or more sub-cooler heat exchanger, oil heat exchanger, or water-based intercooler of the sub-cooled return line.

10. A method for an engine, comprising:

during a first condition when engine speed is above a threshold speed, adjusting a resistance of a radiator main return line arranged in parallel with a sub-cooled return line to a first level, the radiator main return line coupled between a radiator and a crankshaft driven coolant pump, where a speed of the coolant pump increases proportionally with increasing engine speed; and during a second condition when engine speed is below the threshold speed, adjusting the resistance of the radiator main return line to a second level, the second level higher than the first level, where the threshold speed is based on a fluid pressure required to fully flood components in the sub-cooled return line during the second condition.

11. The method of claim 10, wherein adjusting the resistance of the radiator main return line includes adjusting a position of a valve positioned in the radiator main return line, downstream of where the sub-cooled return line branches off from the radiator main return line.

12. The method of claim 11, wherein adjusting the resistance of the radiator main return line to the first level includes increasing an opening of the valve to decrease the resistance in the radiator main return line and wherein adjusting the resistance of the radiator main return line to the second level includes decreasing an opening of the valve to increase the resistance in the radiator main return line.

13. The method of claim 10, wherein the second level is greater than a resistance of the sub-cooled return line and wherein coolant flows through both the radiator main return line and the sub-cooled return line during both the first condition and the second condition.

14. The method of claim 10, wherein the coolant pump is an only pump fluidly coupled to the radiator main return line and the sub-cooled return line and further comprising, during the first condition and second condition, flowing coolant from the coolant pump, through each of the engine and an EGR cooler, in parallel, then through the radiator, and then to an inlet of each of the sub-cooled return line and the main radiator return line.

15. An engine cooling system, comprising:

a single coolant pump driven by an engine crankshaft;

an engine positioned downstream from the single coolant pump;

a radiator positioned downstream from the engine;

a radiator main return line coupled between the radiator and the single coolant pump, the radiator main return line including a restrictive element;

a sub-cooled return line arranged in parallel with the radiator main return line;

an EGR cooler positioned downstream from the single coolant pump and in parallel with the engine, where cooled engine coolant flows from the single coolant pump to each of the engine and the EGR cooler and warmer engine coolant exits each of the engine and EGR cooler and rejoins into a heated engine coolant line that couples to an inlet of the radiator; and a controller with computer readable instructions for adjusting a position of the restrictive element based on engine speed alone, the restrictive element maintaining non-zero flow through the radiator main return line at all positions.

16. The system of claim 15, wherein a speed of the coolant pump increases proportionally with increasing engine speed.

17. The system of claim 16, wherein the EGR cooler is positioned vertically above the single coolant pump with respect to a ground on which a vehicle in which the engine cooling system is installed sits and wherein the radiator is positioned vertically above the EGR cooler.

18. The system of claim 15, wherein the sub-cooled return line includes a sub-cooler heat exchanger, an oil heat exchanger, and a water-based intercooler.

19. The system of claim 18, wherein the radiator is positioned vertically above the sub-cooler heat exchanger and wherein the sub-cooler heat exchanger is positioned vertically above the oil heat exchanger and the single coolant pump.

20. An engine cooling system, comprising:

a single coolant pump driven by an engine crankshaft;

an engine positioned downstream from the single coolant pump;

a radiator positioned downstream from the engine;

a radiator main return line coupled between the radiator and the single coolant pump, the radiator main return line including a restrictive element;

a sub-cooled return line arranged in parallel with the radiator main return line; and a controller with computer readable instructions for adjusting a position of the restrictive element based on engine speed alone, the restrictive element maintaining non-zero flow through the radiator main return line at all positions, wherein the restrictive element includes a dual-orifice valve movable between a first position restricting flow through the radiator main return line and a second position allowing unrestricted flow through the radiator main return line, wherein the first position aligns a smaller diameter orifice with a flow path of the radiator main return line and the second position aligns a larger diameter orifice with the flow path of the radiator main return line.

* * * * *